US009186777B2

(12) United States Patent
Woods

(10) Patent No.: US 9,186,777 B2
(45) Date of Patent: Nov. 17, 2015

(54) ASSEMBLY FIXTURE FOR A WORKPIECE

(71) Applicant: Raymond Woods, Traverse City, MI (US)

(72) Inventor: Raymond Woods, Traverse City, MI (US)

( * ) Notice: Subject to any disclaimer, the term of this patent is extended or adjusted under 35 U.S.C. 154(b) by 348 days.

(21) Appl. No.: 13/919,087

(22) Filed: Jun. 17, 2013

(65) Prior Publication Data

US 2013/0341848 A1 Dec. 26, 2013

Related U.S. Application Data

(60) Provisional application No. 61/662,520, filed on Jun. 21, 2012.

(51) Int. Cl.

| | |
|---|---|
| ***B25B 11/02*** | (2006.01) |
| ***B25B 5/00*** | (2006.01) |
| ***B25B 5/02*** | (2006.01) |
| ***B25B 5/04*** | (2006.01) |
| ***B25B 5/14*** | (2006.01) |

(52) U.S. Cl.

CPC ..... *B25B 11/02* (2013.01); *B25B 5/003* (2013.01); *B25B 5/02* (2013.01); *B25B 5/04* (2013.01); *B25B 5/14* (2013.01)

(58) Field of Classification Search

CPC ..... B25B 11/02; B25B 5/02; B25B 5/04; B23Q 3/00; B23Q 3/02; B23Q 3/003; B23Q 3/069

USPC ..... 269/37, 40

See application file for complete search history.

(56) References Cited

U.S. PATENT DOCUMENTS

| | | | | |
|---|---|---|---|---|
| 1,973,238 | A * | 9/1934 | Gustave | 269/101 |
| 2,458,370 | A * | 1/1949 | Geddes | 269/45 |
| 2,991,669 | A * | 7/1961 | Stock | 269/154 |
| 3,872,760 | A * | 3/1975 | Desnoyers, Jr. | 83/743 |
| 5,435,533 | A * | 7/1995 | Weinmann, Jr. | 269/228 |
| 5,931,726 | A * | 8/1999 | Peters | 451/305 |
| 6,484,378 | B1 * | 11/2002 | Arvin | 29/281.5 |
| 8,393,605 | B2 * | 3/2013 | Yang et al. | 269/287 |
| 8,523,156 | B2 * | 9/2013 | Hou et al. | 269/37 |
| 2002/0005608 | A1 * | 1/2002 | Ausilio | 269/32 |
| 2009/0096143 | A1 * | 4/2009 | Wampler, II | 269/10 |

* cited by examiner

*Primary Examiner* — Lee D Wilson
*Assistant Examiner* — Tyrone V Hall, Jr.
(74) *Attorney, Agent, or Firm* — Dinsmore & Shohl LLP

(57) ABSTRACT

An assembly fixture having a base with an upper surface. A plurality of blocks, each having a quick release clamp detachably secured to it, are positioned on the base so that the clamps engage the workpiece components when in their clamped position. The blocks are then fixedly secured to the base but the clamps may be easily removed and reattached when desired.

4 Claims, 2 Drawing Sheets

ASSEMBLY FIXTURE FOR A WORKPIECE

CROSS-REFERENCE TO RELATED APPLICATIONS

This application claims priority of U.S. Provisional Application 61/662,520 filed Jun. 21, 2012, the contents of which are incorporated herein by reference.

BACKGROUND OF THE INVENTION

I. Field of the Invention

The present invention relates generally to an assembly fixture for a workpiece.

II. Description of Relevant Art

In many shops and manufacturing facilities, fixtures are often created in order to manufacture a particular part or component. These fixtures typically include a generally planar base that is constructed of a rigid material, such as steel, aluminum, or the like. Furthermore, the base is dimensioned so that the component or workpiece being assembled can be positioned, at least in part, on top of the base.

These previously known assembly fixtures are designed to hold two or more components of the final workpiece in a predetermined fixed pattern. Thereafter, the components of the workpiece are secured together by any conventional means, such as welding, riveting, or other fastening. After the components are secured together, the workpiece is removed from the base and new components to form a subsequent workpiece are then positioned on the base in the predetermined pattern.

In order to hold the components of the workpiece in their fixed pattern during the assembly operation, quick release clamps are conventionally mounted to the base around the workpiece components. These quick release clamps are movable from a clamped position in which the clamps engage and hold the workpiece components, and a release position in which the clamps retract away from the workpiece components after assembly to allow the assembled components to be removed from the base. Quick release clamps, furthermore, are desired as opposed to standard clamps since the quick release clamps enable the clamps to be moved from their clamped and to their release position rapidly.

Although different means may be used to secure the quick release clamps to the fixture base, oftentimes the quick release clamps are simply welded to the base. After the fixture is no longer required, at least for the time being, the quick release clamps are oftentimes removed from the base and reused with other fixtures. Such reuse of the quick release clamps is desirable due to the relatively high cost of such clamps.

A major difficulty, however, arises after the quick release clamps are removed from the base of the welding fixture. If the clamps are removed and the fixture stored away for a period of time, the subsequent reassembly of the welding fixture by attaching the clamps to the base is both difficult and time consuming. Furthermore, it is not always evident from the fixture base itself what sort of quick release clamps were attached to the base or the orientation of the clamps relative to the base. When this occurs, essentially a redesign of the welding fixture is required in order to ensure that the workpiece components are properly clamped and held together during the assembly operation. Such redesign of the welding fixture, however, is time consuming and may also introduce error into the assembly of the workpiece components. When this occurs, assembled workpieces from an earlier use of the fixture may differ somewhat from the workpieces assembled with the newly designed assembly fixture.

Furthermore, in the event that the clamp fails, it has been previously necessary to remove the broken clamp and weld a new clamp precisely in its place. Such clamp replacement is time consuming and stops the whole production line using the fixture.

SUMMARY OF THE PRESENT INVENTION

The present invention provides an assembly fixture which overcomes the above mentioned disadvantages of the previously known assembly fixtures.

In brief, the assembly fixture of the present invention comprises a base constructed of a rigid material, such as steel, and having an upper surface. The base is dimensioned so that the workpiece to be assembled by the fixture may be supported by the base.

A plurality of blocks are also provided and each block has an upper and a lower surface. A quick release clamp is detachably secured to the upper surface of each block. Although different means may be used to detachably secure the clamps to their associated blocks, preferably the block includes at least one threaded bore so that an externally threaded fastener may be used to secure the clamp to its associated block.

During the initial design of the assembly fixture, the blocks with their attached clamps are positioned on the base at positions selected so that, when the clamps are moved to their clamping position, the quick release clamps engage the components of the workpiece and hold those components of the workpiece together during the assembly operation. Conversely, after completion of the assembly operation, the clamps are moved to their release position thus allowing the now assembled workpiece to be removed.

After the blocks are properly positioned on the workpiece, the blocks are secured to the base in any conventional fashion, such as by welding. By fixedly securing the blocks to the base, the position of each block is immovably established.

The threaded fasteners that are used to secure the clamp to its associated block allow the clamps to be easily removed from the base and used for other fixtures or other purposes when the use of the fixture is no longer required.

Each block, furthermore, includes indicia on its upper surface indicative of the type of clamp associated with that particular block. In addition, additional indicia on the upper surface of the blocks may indicate the thread size for the fasteners which detachably secure the quick release clamps to their associated block, as well as the orientation of the quick release clamp on the block.

Consequently, even after a period of nonuse of a particular fixture and when the clamps have been removed from their blocks on the fixture, the fixture may be easily and rapidly reconstructed. This rapid reconstruction of the fixture is possible since each block is not only fixed to the base, but also includes indicia identifying not only the type of clamp associated with that block, but also its orientation and, optionally, the thread size to secure the clamp to its associated block.

BRIEF DESCRIPTION OF THE DRAWING

A better understanding of the present invention will be had upon reference to the following detailed description, when read in conjunction with the accompanying drawing, wherein like reference characters refer to like parts, and in which.

DETAILED DESCRIPTION OF A PREFERRED EMBODIMENT OF THE PRESENT INVENTION

Figure 1:
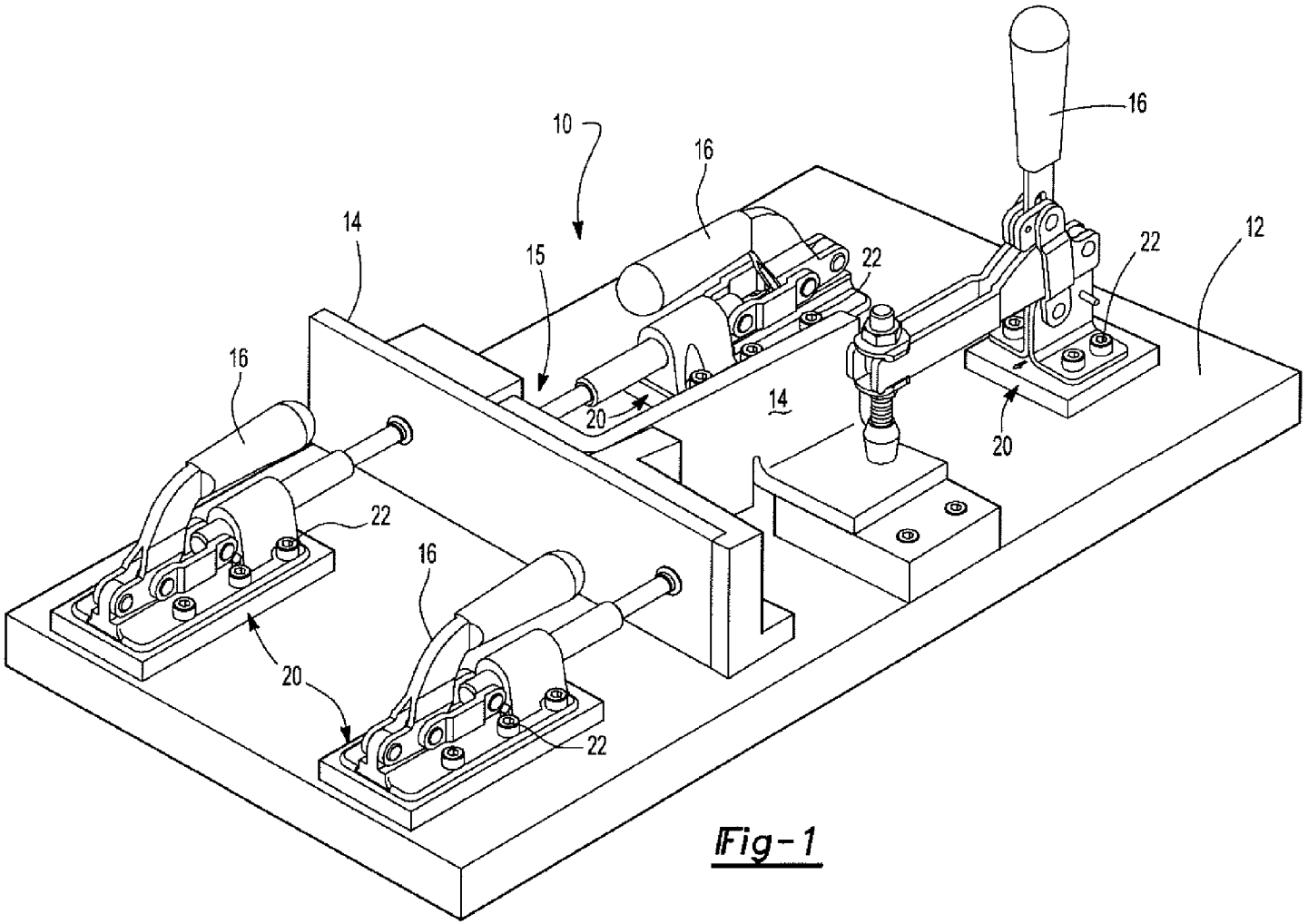
FIG. 1 is an elevational view illustrating a preferred embodiment of the welding fixture of the present invention.

With reference first to FIG. 1, an exemplary welding fixture 10 is shown having a base 12. The base 12 is generally planar and is constructed of any suitable rigid material, such as steel, aluminum, etc.

The fixture 10 is designed to hold two or more components 14 of a workpiece together in a predetermined position relative to each other. When so positioned, the components 14 are secured together in any conventional fashion, such as by welding, fasteners, etc. In the conventional fashion, the fixture 10 itself allows these components 14 of the workpiece 15 to be positioned rapidly and accurately relative to each other during the assembly operation.

In order to hold the components 14 of the workpiece 15 in their predefined position on the base 12 during the assembly operation, the fixture 10 includes a plurality of quick release clamps 16 which are mounted to the base 12 in the fashion subsequently described in greater detail. Each clamp 16, furthermore, is movable between a clamped position and an unclamped position. In their clamped position, the clamps 16 engage one or more components 14 of the workpiece 15 to hold that component against movement in its predefined position relative to the base 12. Conversely, in their release position, the clamps 16 are retracted away from the workpiece after assembly to allow the assembled workpiece to be removed from the fixture 10.

Figure 2:
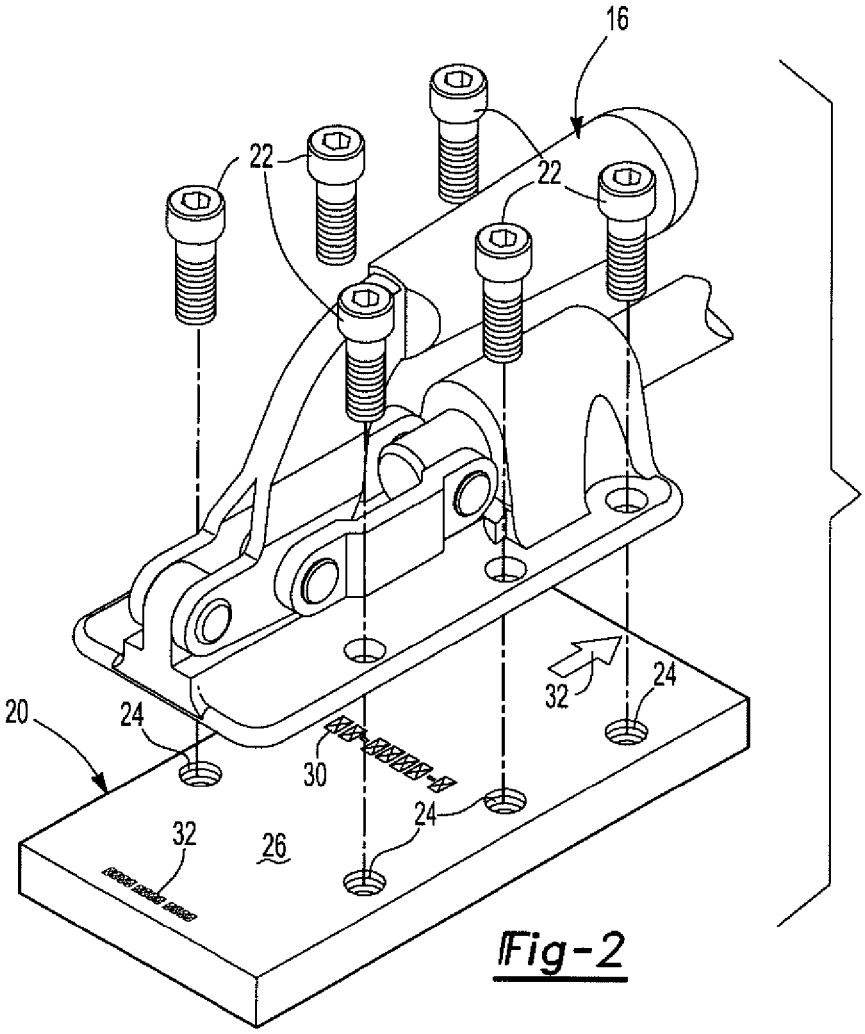
FIG. 2 is an exploded view illustrating the attachment of one clamp to its associated block.

With reference now to FIG. 2, a block 20 is associated with each quick release clamp 16. The block 20 is constructed of a material compatible with the fixture base and preferably of the same material as the fixture base.

Each clamp 16 is attached to its associated block 20 by one or more threaded fasteners 22. These threaded fasteners 22 threadably engage internally threaded holes 24 in the block 20 to securely attach the clamp 16 to its associated block 20. However, when desired, the clamp 16 may be removed from its associated block by simply removing the fasteners 22.

Still referring to FIG. 2, each block contains various indicia on its upper surface 26 which relates to its associated clamp 16. For example, the indicia includes part number indicia 30 which identifies its particular type of associated clamp 16. Direction indicia 32 on the upper surface 26 of the block 20 indicates the direction of orientation of the clamp 16 relative to the block. The block 20 can also contain further indicia, such as website information indicia 32 which may contain operating or purchase information. Still other indicia, such as thread size for the threaded fasteners 22, may also be contained on the upper surface 26 of the block 20.

Figure 3:
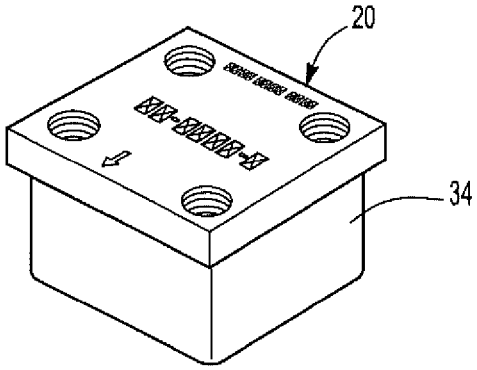
FIG. 3 is an elevational view of a block with an optional spacer.

With reference now to FIG. 3, it is occasionally necessary to elevate the clamp 16 in order to properly interact with the components 14 of the workpiece 15. When this is true, a spacer 34 may be attached to the bottom side of the block 20. Any conventional means, such as welding, an adhesive, and/or the like may be used to secure the spacer 34 and block 20 together.

In use, a workpiece 15, or components 14 for the workpiece 15, are first positioned on the base 12 so that the components 14 are in their desired position following assembly. The clamps 16 with their attached blocks 20 are then positioned on the base 12 at a position necessary to align the workpiece components 14 together for assembly. Consequently, with the clamps 16 properly positioned on the base 12, the clamps 16 engage the workpiece components 14 when in their clamped position, but are retracted away from the workpiece when in their retracted position. Furthermore, when in their clamped position, the clamps 16 firmly hold the components 14 together in their desired position during the assembly operation.

With the clamps 16 properly positioned on the base 12, the blocks 20 are fixedly secured to the plate 12. Any conventional means for fixing the blocks to the plate 12 may be used, such as welding, an adhesive, and/or the like.

The assembly fixture may then be used repeatedly to assemble the components 14 into sequential workpieces 15. When no further workpieces are needed, the clamps 16 may be easily and simply removed from their associated blocks 20 by simply unscrewing the fasteners 22 and removing the clamps 16. The clamping fixture 10, including the base 12 and its attached blocks 20, may then be stored.

If a subsequent use of the fixture 10 is required, the fixture may be easily reassembled by simply reattaching the clamps 16 to their associated blocks 20. In order to facilitate this reassembly, the identification of the type of clamp as well as its orientation on the block 20 is provided by the indicia on the upper surface of each block 20.

From the foregoing, it can be seen that the present invention provides a simple yet effective assembly fixture which may be easily disassembled and reassembled as desired. Having described my invention, however, many modifications thereto will become apparent to those skilled in the art to which it pertains without deviation from the spirit of the invention as defined by the scope of the appended claims.

I claim:

1. An assembly fixture for a workpiece comprising:

a base having an upper surface, a plurality of blocks, each block having an upper and lower surface, a clamp associated with and detachably secured to said upper surface of each block, said lower surface of each block being positioned on said base at positions selected to detachably hold the workpiece to said base at a predetermined position upon movement of each said clamp to a clamping position, said blocks being fixedly and non-removably secured to said base by welding at said positions, wherein said top surface of each block, contains indicia identifying its associated clamp, said indicia indicating the type and orientation of its associated clamp.

2. The fixture as defined in claim 1 wherein each said block contains at least one threaded hole and wherein said clamp is attached to its associated block by a threaded fastener which engages said threaded hole.

3. The fixture as defined in claim 2 where said top surface of each block contains indicia identifying the size of said threaded fastener.

4. The fixture as defined in claim 1 wherein said base is planar in shape.

* * * * *